US006758731B2

(12) United States Patent
Dutterer et al.

(10) Patent No.: US 6,758,731 B2
(45) Date of Patent: Jul. 6, 2004

(54) ORBITAL SANDER

(75) Inventors: David Eric Dutterer, Williamston, SC (US); David G. Peot, Easley, SC (US); Kenneth M. Brazell, Piedmont, SC (US); Ernest Chandler Bostic, Easley, SC (US); Michael Halbert McQuinn, Easley, SC (US); Charles M. Wacker, Belton, SC (US)

(73) Assignee: One World Technologies Limited, Hamilton (BM)

( * ) Notice: Subject to any disclaimer, the term of this patent is extended or adjusted under 35 U.S.C. 154(b) by 0 days.

(21) Appl. No.: 09/927,282

(22) Filed: Aug. 10, 2001

(65) Prior Publication Data

US 2003/0032381 A1 Feb. 13, 2003

(51) Int. Cl.[7] ..... B24B 23/00
(52) U.S. Cl. ..... 451/357; 451/343; 451/453
(58) Field of Search ..... 451/357, 343, 451/344, 294, 453, 456

(56) References Cited

U.S. PATENT DOCUMENTS 5,018,314 A * 5/1991 Fushiya et al. ..... 451/357
5,061,090 A 10/1991 Kriaski et al.
5,317,838 A 6/1994 Bourner
5,323,823 A 6/1994 Kopras
5,384,984 A 1/1995 Smith
5,392,568 A 2/1995 Howard, Jr. et al.
5,402,604 A 4/1995 Hashii et al.
5,419,737 A * 5/1995 Brazell et al. ..... 451/453
5,425,666 A * 6/1995 Frank et al. ..... 451/344
5,453,040 A * 9/1995 Schaal et al. ..... 451/344
5,458,533 A * 10/1995 Barth et al. ..... 451/357
5,518,442 A 5/1996 Clowers et al.
5,558,566 A 9/1996 Hashii et al.
5,580,302 A 12/1996 Howard, Jr. et al.
5,595,531 A * 1/1997 Niemela et al. ..... 451/357
5,607,343 A 3/1997 Keith, Jr. et al.
5,624,302 A 4/1997 Hashii et al.
5,791,977 A 8/1998 Clowers et al.
5,807,169 A 9/1998 Martin et al.
5,813,805 A 9/1998 Kopras
5,813,903 A 9/1998 Amano et al.
5,855,504 A 1/1999 Hild et al.
5,860,852 A 1/1999 Hashii et al.
5,868,208 A 2/1999 Peisert et al.
5,885,146 A 3/1999 Cockburn
5,934,985 A 8/1999 Clowers et al.
5,941,765 A 8/1999 Taylor
5,947,804 A * 9/1999 Fukinuki et al. ..... 451/357
6,129,618 A 10/2000 Frech
6,132,300 A 10/2000 Martin
6,168,507 B1 * 1/2001 McCracken ..... 451/357
6,179,696 B1 1/2001 Duffy

* cited by examiner

*Primary Examiner*—Dung Van Nguyen
(74) *Attorney, Agent, or Firm*—Brooks Kushman P.C.

(57) ABSTRACT

An orbital sander is provided having a number of novel features including a high speed permanent magnet DC motor having a relatively flat rpm versus torque curve. The sander includes an AC to DC power supply, a remotely located on/off switch operated by a switch actuator bar extending transversely through the housing enabling the operator to actuate the on/off switch by alternatively pushing opposed ends of the actuator bar. The orbital sander further includes a fan having non-uniformly spaced blades, eliminating the need for a conventional counterweight, and a dust outlet adapted to be alternatively connected to a dust canister or alternate size collector vacuum hoses.

28 Claims, 4 Drawing Sheets

ORBITAL SANDER

BACKGROUND OF THE INVENTION

1. Field of the Invention

This application relates to orbital tools and in particular, small handheld palm sanders.

2. Background Art

Orbital palm sanders are widely used for a variety of sanding operations from woodworking to auto body repair. Orbital palm sanders come in two general types; random orbit sanders and pad sanders. Random orbit sanders typically have a round sanding platen which supports a sandpaper disc mounted on a central pivot bearing which is rotated about an orbital path. The sanding platen moves in an orbital pad but, is otherwise free to rotate about a bearing. Pad sanders are typically very similar in construction to a palm-type random orbit sander, however, the sanding platen is constrained so that it can orbit, but cannot freely rotate relative to the housing. An example of such a tool is a quarter sheet sander having a generally square sanding platen. A third variant, although not common, is an eccentric sander where the sanding platen orbits at high speed about the motor axis while being slowly rotated by an eccentric gear pair.

Orbital palm sanders are generally small and compact, and have a motor axis which extends perpendicular to the sanding platen. The output end of the motor is connected to the sanding platen by an eccentrically located drive bearing. In the case of the random orbit sander, the bearing is the sole connection between the platen and the eccentric drive. In the case of the pad sander, a sanding platen will be restrained from rotating by elastomeric elements. In the case of an eccentric sander, the sanding pad rotation relative to the housing will be controlled by an eccentric gear pair.

Orbital sanders are frequently provided with a dust collection feature. In order to collect dust, the sanding platen will have a series of apertures formed therethrough corresponding to matching apertures in the sandpaper. An internal fan associated with the eccentric drive cooperates with a chamber in the motor housing to extract air and dust through the sanding platen and discharge the air dust through an outlet port connected to a dust canister or a remote collector vacuum. The eccentric drive and fan assembly is frequently made of die cast zinc and commonly includes a cast counterweight sized to balance the eccentric drive fan and sanding platen sub assembly relative to the motor axis. The eccentric drive fan counterweight assemblies are typically individually balance tested and machined in order to compensate for part to part manufacturing variability, particularly in higher price palm sanders where a smooth balance is desired.

SUMMARY OF THE INVENTION

The orbital sander embodiment of the present invention contains a number of novel features. The preferred sander embodiment is driven by a high speed permanent magnet DC motor which has a relatively flat RPM versus torque curve. As a result, the motor decreases in speed relatively little from the no load speed in contrast to universal motors employed in the prior art. The preferred embodiment drops in speed less than 25% when the load is increased from the no load speed to the maximum continuous operating rated load.

Additionally, the preferred embodiment of the invention utilizes a novel eccentric drive and fan member where the fan is provided by an annular disc extending normal to the motor axis having a series of integrally formed blades circumaxially spaced about the disc in a non-uniform manner. The relative concentration of fan blades in one region of the discs and the sparse spacing of fan blades in a diametrically opposite region results in an imbalance which is used to counter-balance the eccentrically offset sanding platen which is pivotally attached thereto without using a conventional balance weight. This prevents casting irregularities resulting in poor balance control.

The preferred embodiment further has a unique on/off switch and switch actuator. The on/off switch is located internal to the housing and a switch actuator bar extends transversely through the housing, lying in a plane perpendicular to the motor axis. The switch actuator bar has two opposed ends. At least one end extends from the housing at all times, enabling the operator to switch between the on and off position by pushing on the opposed ends of the actuator bar located transversely on opposite sides of the housing per portion.

The orbital sander further has a novel dust collection outlet port which facilitates the use of a dust collection cannister or two alternative sized dust collection vacuums.

The above novel features, as well as other advantages and characteristics of the present invention will be readily appreciated by one of ordinary skill of the art from the reviewing the following detailed description of the best mode for carrying out the invention when taken in connection with the accompanying drawings.

DETAILED DESCRIPTION OF THE PREFERRED EMBODIMENT(S)

Figure 1:
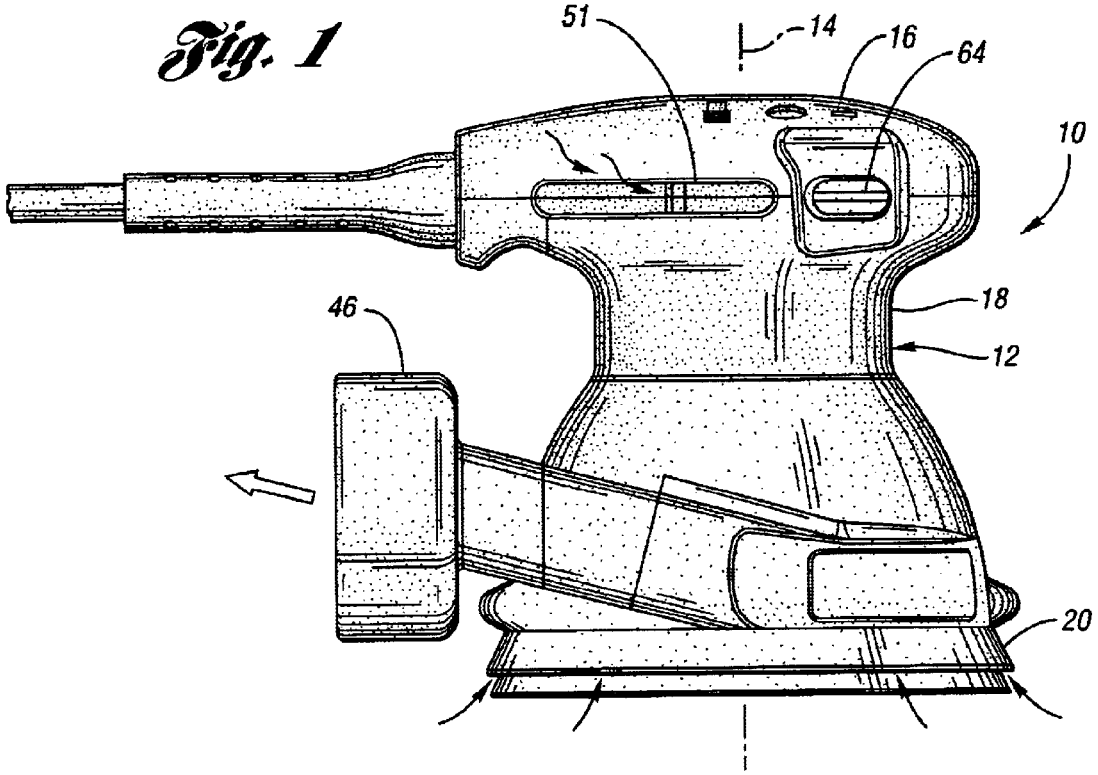
FIG. 1 is a side elevational view of an orbital tool, namely, a random orbit palm sander made in accordance with the present invention.
Figure 2:
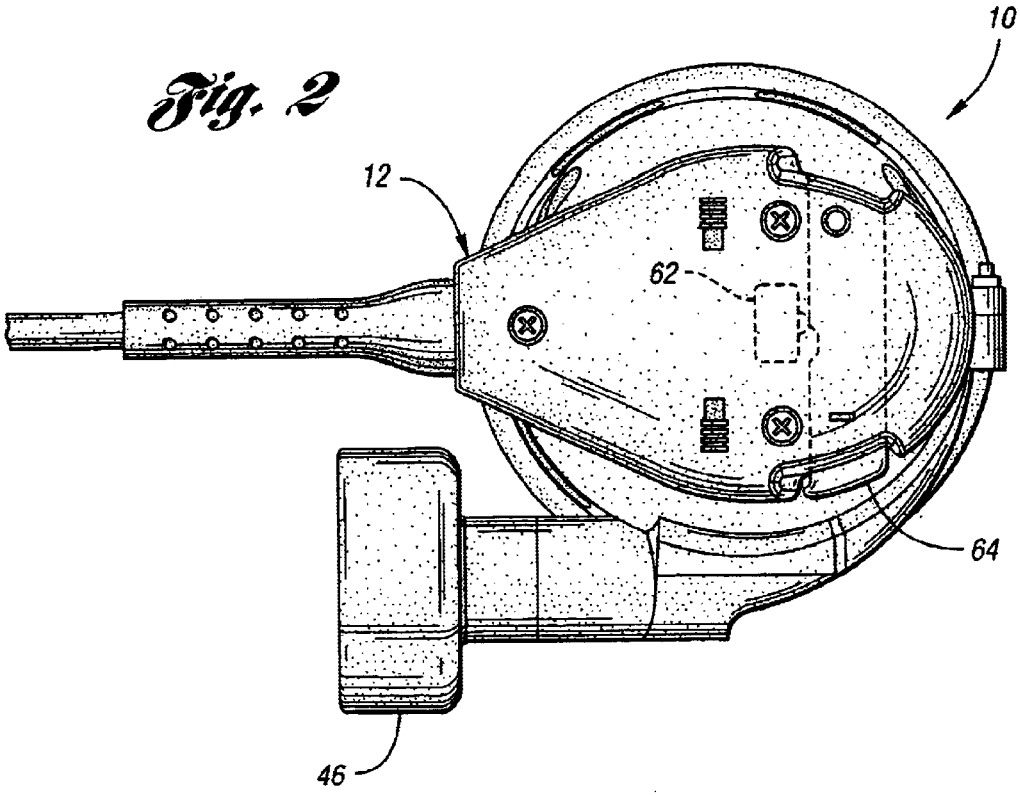
FIG. 2 is a top plan view of the sander of FIG. 1.
Figure 3:
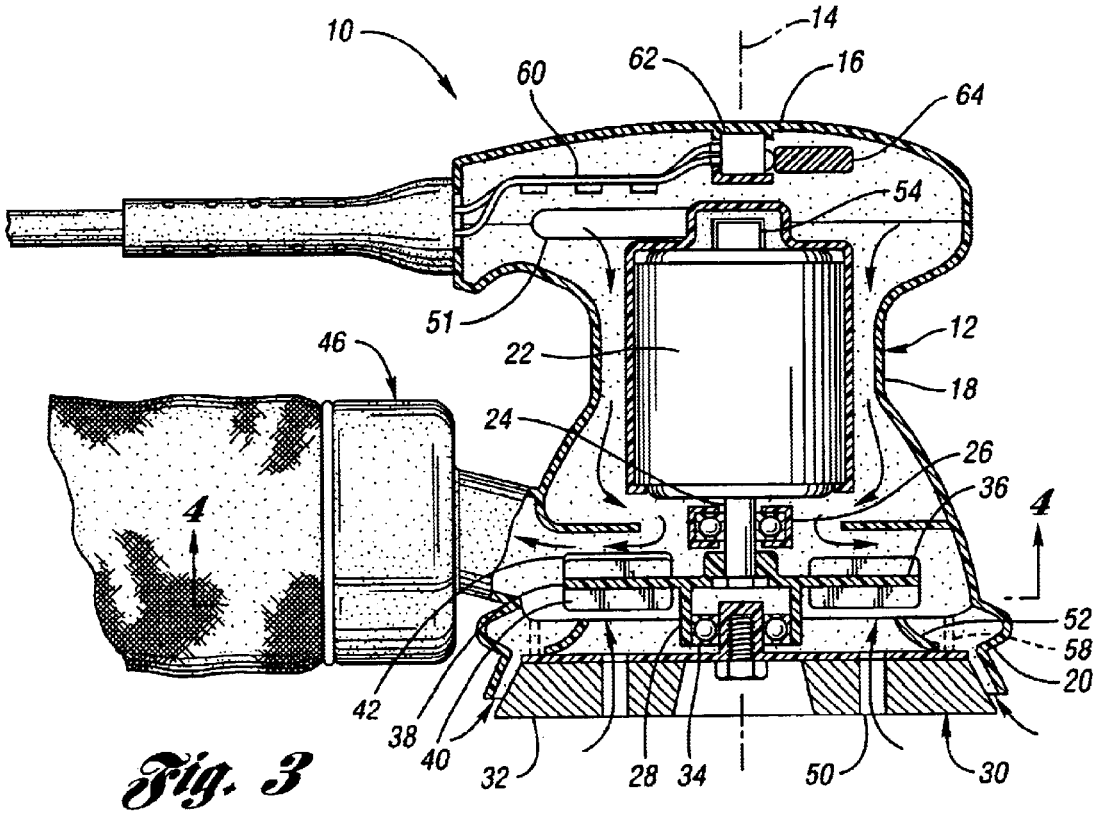
FIG. 3 is a cutaway side elevational view of the embodiment in FIG. 1.

Random orbit palm sander 10 shown in FIGS. 1 through 4 illustrates a preferred embodiment of the invention. The random orbit palm sander 10 is made up of an elongate tubular housing assembly 12 which is aligned along a generally vertical central axis 14. The housing has an upper first end 16, a central tubular region 18 and a open lower second end 20. Oriented within housing assembly 12 and generally aligned with central axis 14 is a high speed permanent magnet DC motor 22. The motor has a generally cylindrical body sized to fit within the housing tubular portion 12 and a rotary motor output shaft 24. Motor output shaft 24 is affixed to eccentric drive hub 26 which has an output member 28 which is eccentrically offset from the motor central axis. A sanding platen 30 is oriented adjacent to housing second end 20. This sanding platen 30 has a planar surface 32 which is perpendicular to central axis 14 and is adapted to receive sandpaper. Interposed between the eccentric drive hub 26, drive member 28 and the sanding platen 30 is the bearing 34. Bearing 34 can be any one of a number of conventional design. In the embodiment illustrated, the bearing has an outer race which presses onto drive member 28 and an inter race which cooperates with fastening bolts for removably mounting the sanding platen. Preferably, bearing 34 in a sealed high speed roller or ball bearing assembly.

Preferably, the eccentric drive hub 26 further includes a fan 36 for cooling the motor and for collecting dust. Fan 36 has a disc portion 38 and a plurality of lower fan blades 40 and upper fan blades 42. Rotation of the motor output shaft 24 causes fan 36 to rotate about central axis 14. The fan moves air radially outward from a region adjacent the motor axis to a zone outboard of the fan periphery. The fan additionally causes the air to swirl in a counter-clockwise direction (when viewed from the bottom in FIG. 4) within the fan cavity 44 which is formed in the second end 20 of housing assembly 12. Lower fan blades 40 cause air to be drawn through ports 50 formed in sanding platen 30 in order to collect dust formed by the sanding process. Additionally, fan 40 tends to draw air through the annular opening formed between the sanding platen outer periphery and housing 20. However, this flow path is obstructed by annular seal/brake 52 which serves to provide a friction brake limiting the free spinning velocity of the sanding pad when the motor is energized without the sanding platen engaging a work piece.

The upper fan blades 42 on the upper surface of disc 38 serve to draw air generally axially through the central tubular region 18 of housing 12 in order to cool the motor. Air inlet ports 51 are located in the outer periphery of the housing first end 16 allowing air to enter the housing, flow around the motor and exit the housing fan cavity 44 via discharge port 46.

Figure 4:
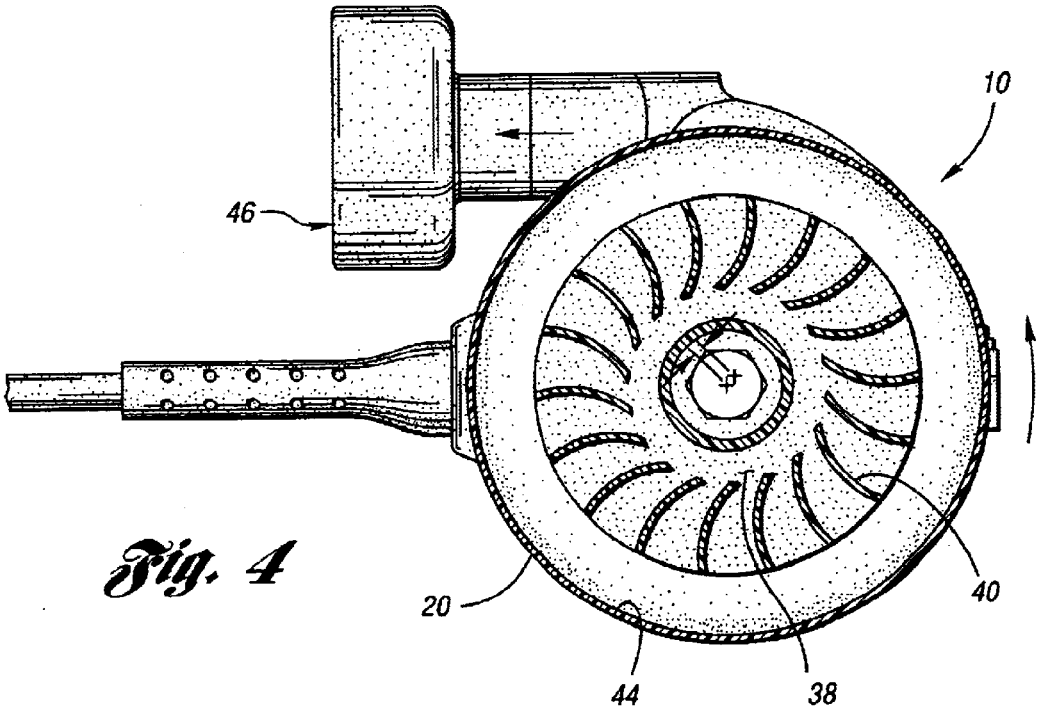
FIG. 4 is a view taken along 4—4 of FIG. 3 illustrating the configuration of the fan blades.

Preferably, as illustrated in FIG. 4, the fan blades are of a radial tip configuration, the outermost radial tip of each blade is generally aligned along a radial axis of the motor. The fan blades curve inwardly and are generally cupped in the direction of rotation as shown in FIG. 4. Other fan blade shapes can be utilized, such as a backward incline, backward curve, an airfoil forward curve, or a radial blade. The radial tip fan blade configuration is selected as the best compromise in the present application considering efficiency, noise and performance characteristics. The lower fan blades 40 are generally identical in configuration and the upper fan blades 42. The upper fan blades being slightly shorter than the lower fan blades as less flow is required through the motor housing than is required for dust collection purposes.

The entire fan 36 which is made up of upper fan blades 42, lower fan blades 40 and disc 38 is formed with the eccentric drive hub 26 as an integral die cast unit. Preferably, the eccentric drive shaft fan unit is die cast zinc and most preferably formed ZMAK5™. The die cast fan is machined to receive the motor shaft 24 and bearing 34. The fan portion of the eccentric drive shaft unit is preferably not machined and is used as cast. In the present embodiment, no thick counterweight is used on the eccentric drive shaft hub fan unit; rather, the fan blades are non-uniformly distributed about the fan concentrating the fan blades more closely spaced on one side than the diametrically opposite region. The weight caused by the increased concentration of fan blades creates a rotary imbalance which is designed to exactly offset the rotary imbalance caused by the offset location of the attached sanding platen 30. Since all of these sections of the cast fan are thin, porosity is not a problem. Therefore, the weight of the as-cast fan is very predictable eliminating the need for individual balancing of the fan resulting from weight variations caused by the porosity commonly occurring in the thick cross-section counterweight of the prior art.

Figure 5:
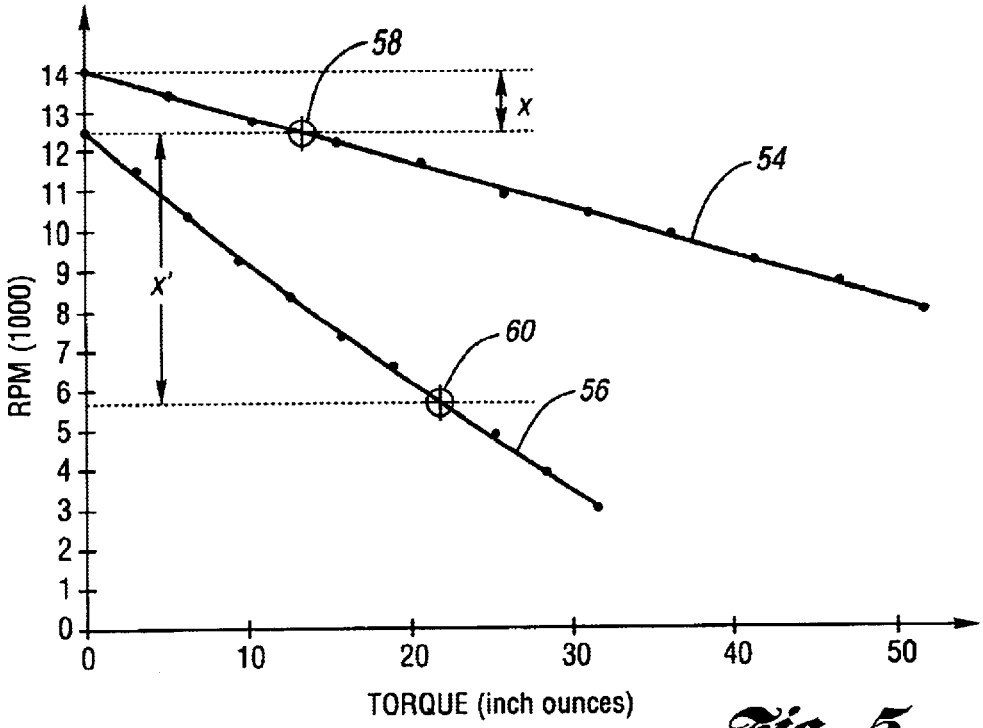
FIG. 5 is a plot of the RPM torque curve of the permanent magnet DC motor used in the disclosed orbital sander when compared to a conventional universal motor used in a prior art palm sander.

The use of a high-speed permanent magnet DC motor in the present application as opposed to the traditional universal motors common in the prior art palm sanders results in a unique speed versus torque characteristic. A plot of RPM versus torque for the present motor is shown at line 54 in FIG. 5. Line 56 represents the RPM versus torque curve for a traditional universal motor used in a random orbit palm sander. Point 58 represents the speed and load for DC motor 22 at maximum continuous operation rated load. A RPM of 12,540 at a torque of 13.2 inch ounces resulting in a current draw of approximately 2.4 amps providing approximately 1.6 horsepower. The prior art universal motor has a maximum continuous operation rated load designated by point 60 on curve 56 which corresponds to a motor speed of 5,870 and a torque of approximately 22 inch ounces, a current of 2.4 amps and horsepower of approximately 1.3.

The drop in motor speed from the no-load free-speed to the speed rated load is depicted by the X on data curve 54 representing a drop in speed of a little over 8%. The universal motor of the prior art shown on data curve 56 has a substantially greater drop in speed, X', representing a drop in speed of slightly over 50%. In use, the sander of the present invention will perform significantly different than the prior art sander having a universal motor. The speed of the sander will remain relatively constant as the load and the resulting torque on the motor shaft is varied during usage. Previously, the speed of a random orbit sander in use varies dramatically as a function of load giving the user the perception the tool was underpowered. The DC motor used to implement the present invention should be sized so that motor speed will not drop more than 25% from free-speed to maximum continuous rated load. Preferably, the motor speed will not drop more than 15% and most preferably not more than 10% when the motor's load is increased from the unloaded state to the fully loaded state. Ideally, the motor speed will never drop more than 10% when the load is increased from 50% to 100% of the maximum continuous rated load.

Ideally, the DC motor will be selected for implementing the present invention where the maximum continuous operation rated load occurs at a speed in excess of 10,000 rpm and most preferably at a speed in excess of 11,000 rpm. Preferably, the motor will have a speed in excess of 8,000 rpm when the motor is loaded at a torque of 20 inch ounces, a speed in excess of 10,000 rpm when the motor is loaded at 15 inch ounces, and a speed in excess of 12,000 rpm when the motor is loaded at a torque of 10 inch ounces. Ideally, the motor will have a horsepower rating at maximum continuous rated load in the 0.1 to 0.2 horsepower range. Motor 22 and has a shell of magnetic material for supporting permanent magnets which may further include bearing supports at axial ends of the motor. Ideally, the motor brushes 54 will be accessible when the housing end cap 56 is removed from the tubular body central portion 18.

In the embodiment of the invention illustrated, the sanding platen 30 is free to rotate about bearing 34 with rotation constrained only by the seal/brake 52. In the case of a pad sander, elastic elements 58, shown in phantom outline, extend between housing second end 20 and the sanding platen 30 in order to prohibit free relative rotation and allow the sanding platen to orbit eccentrically. Alternatively, a pair of eccentric gears respectively mounted on the housing and the sanding platen can serve as a retainer to limit free rotation of the sanding platen.

The orbital sander 10 further includes a power supply 60 oriented in the housing first end 12. Power supply 60 has an AC input, i.e., a typical power cord (110 volt or 220 volt depending on the country), a DC rectifier circuit and a DC output supplying power to the motor. A on/off switch 62 is preferably mounted on the power supply board safely within the housing where it is not exposed to dirt and physical abuse. In the preferred embodiment illustrated, a switch actuation bar 64 is provided which extends transversely through the housing and is shiftable along the axis lying in a plane perpendicular to the motor axis 14. The switch actuation bar 64 has opposed ends, at least one of the ends always projects outward of the housing so as to be accessible to the operator. The switch actuation bar is pushed in one direction to turn the motor on and in the opposite direction to turn the motor off. This push/push design is simple for the operator to understand and provides a visual indication of whether the sander is in the on or off state, even when the sander is not plugged in. It is likewise easy to seal the switch actuation bar relative to the housing in order to prevent dirt and dust from reaching the on/off switch 62. The switch actuator bar is provided with a cam surface which cooperates with the switch bottom as illustrated in phantom outline in FIG. 2 to operate the switch.

Figure 6:
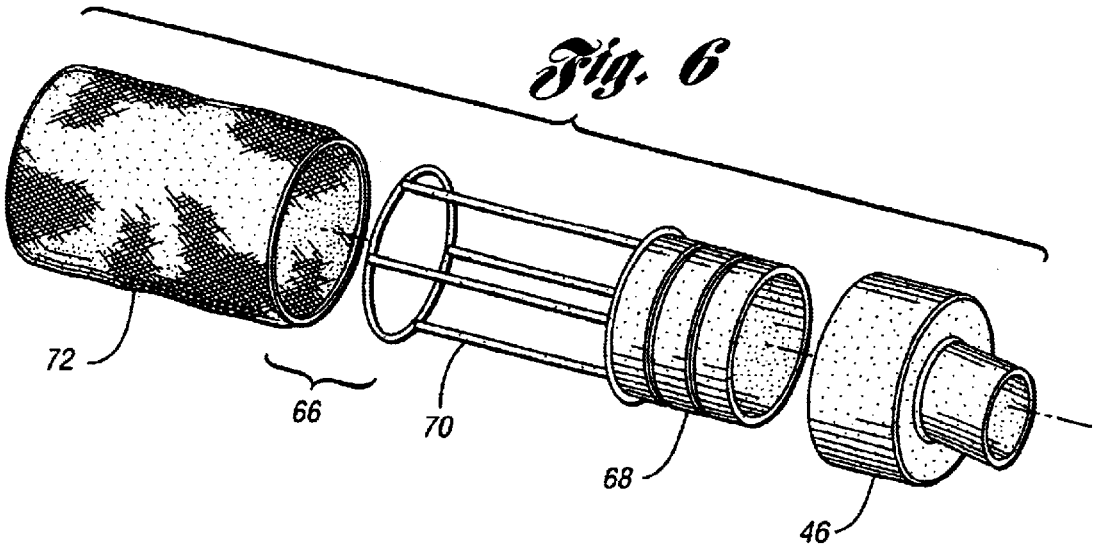
FIG. 6 is an exploded view of a dust collection cannister and the dust collector outlet.
Figure 7:
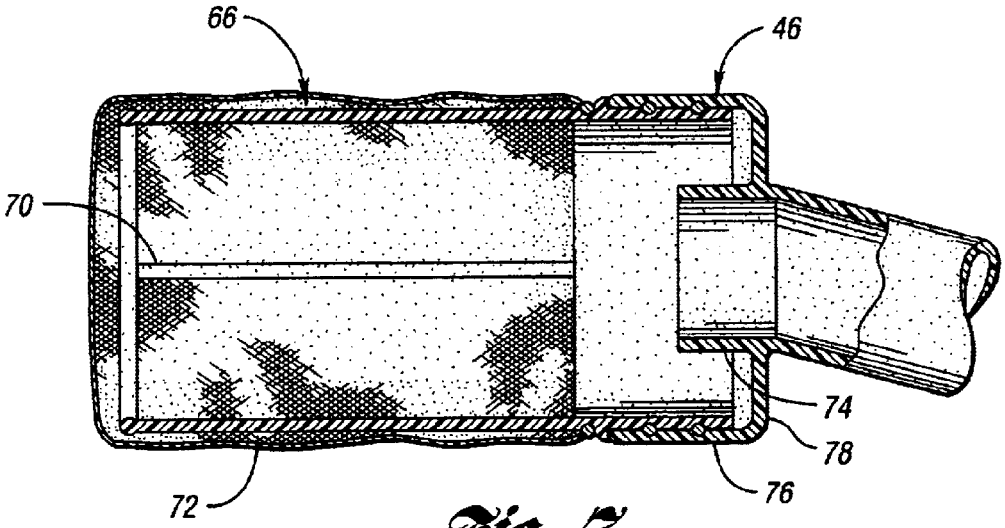
FIG. 7 is a cross-sectional side elevation view of the assembled dust collection cannister and dust collection outlet of the present invention.

The orbital sander of the present invention is further provided with a novel dust collection system. In the dust collection system, dust is drawn into the fan chamber 44 through dust collection ports 50 by a rotating fan 36. The dustladen air exits fan chamber 44 through discharge outlet 46. The discharge outlet can be alternatively connected to a dust collection canister 66, shown in FIGS. 6 and 7 or to a collector vacuum. Dust collection canister 66 has a tubular portion 68 adapted to removably attach to discharge outlet 46. Tubular portion 68 has fixed to it a supporting frame 70 for maintaining dust collection bag 72 in the inflated state. Dust collection bag 72 has an elastic mouth which snaps over a corresponding rib on tubular section 68 to hold the bag securely in place when assembled as shown in FIG. 7. Dust collection canister 66 allows air to escape through bag 72, trapping dust and debris within the bag as illustrated. The illustrated canister works quite well and is simple to empty and clean. Ideally, the support frame 70 is formed without any sharp edges which will puncture the bag 72 and extend its periods of use.

Ideally, the preferred embodiment of the canister is made using a plastic tube and frame and associated fabric bag. Of course, other structures, such as a porous foam box, or a plastic screen with integrally molded support frame, can alternatively be used.

Discharge outlet 46 is made up of a relatively small diameter outlet tube portion 74 about which is oriented a relatively larger diameter collar 76. The collar 76 is affixed to outlet tube 74 by an end wall 78, as illustrated in FIG. 7. Outlet tube 74 extends beyond end wall 78 a significant distance to trap dust and debris within the canister and to prevent backflow when the motor is turned off. Once the canister is full of sawdust, the canister can be removed from the dust outlet 46 and simply emptied and reattached.

Figure 8:
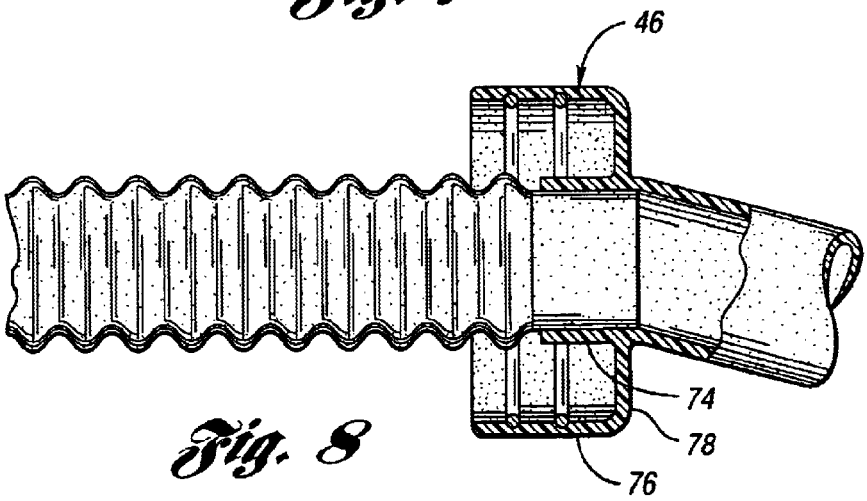
FIG. 8 is a cross-sectional side elevational view of the dust collector outlet attached to a small diameter collector vacuum tube.
Figure 9:
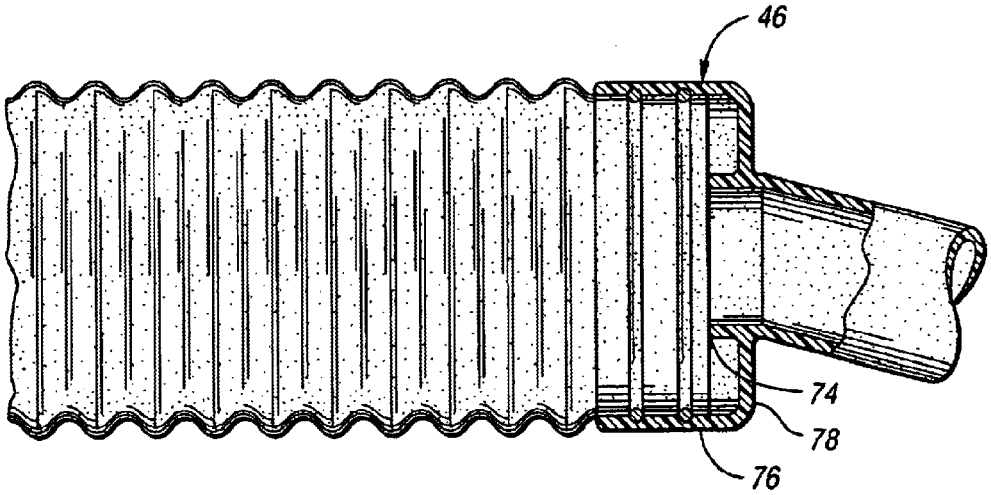
FIG. 9 is a cross-sectional view of the dust collector outlet attached to a large diameter dust collector vacuum tube.

When the orbital sander is used in conjunction with a collector vacuum, a small diameter collector vacuum outlet tube can be telescopically connected directly to small diameter outlet 74, as illustrated in FIG. 8. When a large diameter collector vacuum outlet tube is utilized, the outlet tube is telescopically connected directly to collar 76, as illustrated in FIG. 9. Small diameter outlet tube and collar 74 and 76 can be sized for vacuum tubes traditionally available in the country in which the sander is marketed. Typically, the small diameter outlet tube will be 1 to 1½ inches in diameter, while the collar will have a diameter of 2 to 2¾ inches.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An assembly for an orbital sander comprising:

a drive member rotatable about an axis and having an eccentrically offset hub and a plurality of fan blades;

a sanding member connected to the hub; and the fan blades distributed angularly around the axis in a non-uniform manner to balance the assembly about the axis.

2. The assembly of claim 1 wherein the blades are generally uniform in thickness and the non-uniform distribution of the blades results in the balancing of the assembly without the use of a balance weight.

3. The assembly of claim 2 wherein the blades are of a radial tip configuration.

4. The assembly of claim 1 wherein the fan blades comprise top blades and bottom blades with the top blades located at the top of the drive member, the bottom blades located at the bottom of the drive member in a manner surrounding the hub and one of the top blades and bottom blades being non-uniformly distributed.

5. The assembly of claim 1 wherein the drive member further comprises a disc portion to which the fan blades and hub are attached and the disc portion is generally uniform in thickness and each of the plurality of fan blades are generally uniform in thickness enabling drive member to be integrally formed as a metal die casting with limited porosity so to remove the need for post cast machining.

6. The assembly of claim 5 wherein the drive member is not balanced post cast.

7. An orbital sander comprising:

an elongate housing having a first end, a central region and a second end;

a motor disposed within the housing central region and having a motor shaft extending toward the second end and rotatable about an axis;

a drive member eccentrically driven by the motor shaft and having an integrally formed fan;

a sanding platen oriented adjacent the second end of the housing and orbitally driven by the drive member, the platen having a planar surface perpendicular to the axis adapted to receive sand paper; and the fan distributed around the axis in a non-uniform manner so to balance the drive member and platen about the axis without the use of a balance weight.

8. The orbital sander of claim 7 wherein the fan comprises plurality of fan blades.

9. The orbital sander of claim 8 wherein the blades are generally uniform in thickness and have a non-uniform distribution which results in the balancing of the assembly.

10. An orbital sander comprising:

an elongate tubular housing aligned along the central axis having a first end, a second end and a central tubular region in the second end;

a motor disposed within the housing central tubular region, the motor having a cylindrical body with a central axis and a rotary motor shaft generally coaxially aligned with the central axis;

an eccentric drive shaft rotatably driven by the motor shaft about the central axis and having a drive member eccentrically offset from the central axis;

a sanding platen oriented adjacent to the housing second end and orbitally driven by the drive member, the platen having a planar surface perpendicular to the central axis adapted to receive sand paper;

a bearing interposed between the sanding platen and the eccentric drive shaft drive member freely rotatably connecting the sanding platen and drive member to cause the sanding platen to orbit as the motor rotates; and a switch actuation bar which extends through the housing first end and is shiftable along an axis lying in a plane perpendicular to the motor axis, the switch actuation bar having two opposed ends at least one of which is extending from the housing at all times enabling the operator to turn the motor on and off by alternatively pushing opposed ends of the switch actuation bar which in turn varies the state of an electrical switch mounted internally within the housing.

11. The orbital sander of claim 10 wherein the relatively small dust outlet tube is a nominal diameter to 1" to 1½" while the collar has a diameter of 2" to 2¾".

12. The orbital sander of claim 10 wherein the motor is a high speed permanent magnet DC motor.

13. The orbital sander of claim 12 further comprising a power supply oriented within the housing, the power supply having an input adaptable to be coupled to a source of AC power and DC output electrically connected to the motor.

14. An orbital sander comprising:

an elongate tubular housing aligned along the central axis having a first end, a second end and a central tubular region in the second end and defining an annular dust collection chamber circumaxially extending about the eccentric drive and terminating in a dust outlet;

the dust outlet formed by a relatively small diameter outlet tube having a relatively larger diameter collar spaced thereabout, the small diameter tube sized to cooperate with a small diameter dust collection tube and the larger diameter collar sized to alternatively cooperate with a large diameter tube or a porous dust collection canister;

a motor disposed within the housing central tubular region, the motor having a cylindrical body with a central axis and a rotary motor shaft generally coaxially aligned with the central axis;

an eccentric drive shaft rotatably driven by the motor shaft about the central axis and having a drive member eccentrically offset from the central axis;

a sanding platen oriented adjacent to the housing second end and orbitally driven by the drive member, the platen having a planar surface perpendicular to the central axis adapted to receive sand paper and provided with a plurality of dust collection ports extending therethrough;

a bearing interposed between the sanding platen and the eccentric drive shaft drive member freely rotatably connecting the sanding platen and drive member to cause the sanding platen to orbit as the motor rotates; and the eccentric drive provided with a fan so the rotation of the motor causes the fan to rotate drawing air and dust through the ports in the sanding platen and discharging the air and dust through the dust outlet.

15. The orbital sander of claim 14 wherein the motor is a high speed permanent magnet DC motor.

16. An orbital palm sander comprising:

an elongate tubular housing aligned along the central axis having a first end, a second end and a central tubular region in the second end and sized to allow an operator to grasp and operate the sander with a single hand about the central axis;

a high speed permanent magnet DC motor disposed within the housing central tubular region, the motor having a cylindrical body with a central axis and a rotary motor shaft generally coaxially aligned with the central axis;

an eccentric drive shaft rotatably driven by the motor shaft about the central axis and having a drive member eccentrically offset from the central axis;

a sanding platen oriented adjacent to the housing second end and orbitally driven by the drive member, the platen having a planar surface perpendicular to the central axis adapted to receive sand paper;

a bearing interposed between the sanding platen and the eccentric drive shaft drive member freely rotatably connecting the sanding platen and drive member to cause the sanding platen to orbit as the motor rotates; and the motor speed drops less than 10% when the motor load is increased from the no load condition to the maximum continuous operation rated load.

17. An orbital palm sander comprising:

an elongate tubular housing aligned along the central axis having a first end, a second end and a central tubular region in the second end and sized to allow an operator to grasp and operate the sander with a single hand about the central axis;

a high speed permanent magnet DC motor disposed within the housing central tubular region, the motor having a cylindrical body with a central axis and a rotary motor shaft generally coaxially aligned with the central axis;

an eccentric drive shaft rotatably driven by the motor shaft about the central axis and having a drive member eccentrically offset from the central axis;

a sanding platen oriented adjacent to the housing second end and orbitally driven by the drive member, the platen having a planar surface perpendicular to the central axis adapted to receive sand paper;

a bearing interposed between the sanding platen and the eccentric drive shaft drive member freely rotatably connecting the sanding platen and drive member to cause the sanding platen to orbit as the motor rotates; and the motor speed drops less than 15% when the motor load is increased from the no load condition to the maximum continuous operation rated load.

18. An orbital palm sander comprising:

an elongate tubular housing aligned along the central axis having a first end, a second end and a central tubular region in the second end and sized to allow an operator to grasp and operate the sander with a single hand about the central axis;

a high speed permanent magnet DC motor disposed within the housing central tubular region, the motor having a cylindrical body with a central axis and a rotary motor shaft generally coaxially aligned with the central axis;

an eccentric drive shaft rotatably driven by the motor shaft about the central axis and having a drive member eccentrically offset from the central axis;

a sanding platen oriented adjacent to the housing second end and orbitally driven by the drive member, the platen having a planar surface perpendicular to the central axis adapted to receive sand paper;

a bearing interposed between the sanding platen and the eccentric drive shaft drive member freely rotatably connecting the sanding platen and drive member to cause the sanding platen to orbit as the motor rotates; and the motor speed drops less than 25% when the motor load is increased from the no load condition to the maximum continuous operation rated load.

19. The orbital sander of claim 18 wherein the motor speed at the maximum continuous operation rated load is in excess of 10,000 rpm.

20. The orbital sander of claim 18 wherein the motor speed at the maximum continuous operation rated load is in excess of 11,000 rpm.

21. An orbital palm sander comprising:

an elongate tubular housing aligned along the central axis having a first end, a second end and a central tubular region in the second end and sized to allow an operator to grasp and operate the sander with a single hand about the central axis;

a high speed permanent magnet DC motor disposed within the housing central tubular region, the motor having a cylindrical body with a central axis and a rotary motor shaft generally coaxially aligned with the central axis;

an eccentric drive shaft rotatably driven by the motor shaft about the central axis and having a drive member eccentrically offset from the central axis;

a sanding platen oriented adjacent to the housing second end and orbitally driven by the drive member, the platen having a planar surface perpendicular to the central axis adapted to receive sand paper;

a bearing interposed between the sanding platen and the eccentric drive shaft drive member freely rotatably connecting the sanding platen and drive member to cause the sanding platen to orbit as the motor rotates; and the motor has a speed in excess of 8,000 rpm when the motor is loaded at a torque of 20 in. oz.

22. An orbital palm sander comprising:

an elongate tubular housing aligned along the central axis having a first end, a second end and a central tubular region in the second end and sized to allow an operator to grasp and operate the sander with a single hand about the central axis;

a high speed permanent magnet DC motor disposed within the housing central tubular region, the motor having a cylindrical body with a central axis and a rotary motor shaft generally coaxially aligned with the central, axis;

an eccentric drive shaft rotatably driven by the motor shaft about the central axis and having a drive member eccentrically offset from the central axis;

a sanding platen oriented adjacent to the housing second end and orbitally driven by the drive member, the platen having a planar surface perpendicular to the central axis adapted to receive sand paper; and a bearing interposed between the sanding platen and the eccentric drive shaft drive member freely rotatably connecting the sanding platen and drive member to cause the sanding platen to orbit as the motor rotates; and the motor has a speed in excess of 10,000 rpm when the motor is loaded at a torque of 15 in. oz.

23. An orbital palm sander comprising:

an elongate tubular housing aligned along the central axis having a first end, a second end and a central tubular region in the second end and sized to allow an operator to grasp and operate the sander with a single hand about the central axis;

a high speed permanent magnet DC motor disposed within the housing central tubular region, the motor having a cylindrical body with a central axis and a rotary motor shaft generally coaxially aligned with the central axis;

an eccentric drive shaft rotatably driven by the motor shaft about the central axis and having a drive member eccentrically offset from the central axis;

a sanding platen oriented adjacent to the housing second end and orbitally driven by the drive member, the platen having a planar surface perpendicular to the central axis adapted to receive sand paper;

a bearing interposed between the sanding platen and the eccentric drive shaft drive member freely rotatably connecting the sanding platen and drive member to cause the sanding platen to orbit as the motor rotates; and the motor has a speed in excess of 12,000 rpm when the motor is loaded at a torque of 10 in. oz.

24. An orbital palm sander comprising:

an elongate tubular housing aligned along the central axis having a first end, a second end and a central tubular region in the second end and sized to allow an operator to grasp and operate the sander with a single hand about the central axis;

a high speed permanent magnet DC motor disposed within the housing central tubular region, the motor having a cylindrical body with a central axis and a rotary motor shaft generally coaxially aligned with the central axis;

an eccentric drive shaft rotatably driven by the motor shaft about the central axis and having a drive member eccentrically offset from the central axis;

a sanding platen oriented adjacent to the housing second end and orbitally driven by the drive member, the platen having a planar surface perpendicular to the central axis adapted to receive sand paper;

a bearing interposed between the sanding platen and the eccentric drive shaft drive member freely rotatably connecting the sanding platen and drive member to cause the sanding platen to orbit as the motor rotates; and the motor speed drops less than 10% when the motor load is increased from 50% of the maximum continuous operation rated load to 100% of the maximum continuous operation rated load.

25. An orbital palm sander comprising:

an elongate tubular housing aligned along the central axis having a first end, a second end and a central tubular region in the second end and sized to allow an operator to grasp and operate the sander with a single hand about the central axis;

a high speed permanent magnet DC motor disposed within the housing central tubular region, the motor having a cylindrical body with a central axis and a rotary motor shaft generally coaxially aligned with the central axis;

an eccentric drive shaft rotatably driven by the motor shaft about the central axis and having a drive member eccentrically offset from the central axis;

a sanding platen oriented adjacent to the housing second end and orbitally driven by the drive member, the platen having a planar surface perpendicular to the central axis adapted to receive sand paper; and a bearing interposed between the sanding platen and the eccentric drive shaft drive member freely rotatably connecting the sanding platen and drive member to cause the sanding platen to orbit as the motor rotates;

the eccentric drive further comprises a fan having a disc extending about and lying in a plane perpendicular to the motor axis and a plurality of generally uniformly shaped blades circumaxially spaced about the disc in a non-uniform manner in order to balance the eccentric drive and sanding platen sub-assembly about the motor axis; and the blades are generally uniform in thickness and that the non-uniform distribution of the blades results in balancing the eccentric drive sanding platen assembly without the use of balanced weight.

26. The orbital sander of claim 25 wherein the blades are of the radial tip configuration.

27. An orbital palm sander comprising:

an elongate tubular housing aligned along the central axis having a first end, a second end and a central tubular region in the second end and sized to allow an operator to grasp and operate the sander with a single hand about the central axis;

a high speed permanent magnet DC motor disposed within the housing central tubular region, the motor having a cylindrical body with a central axis and a rotary motor shaft generally coaxially aligned with the central axis;

an eccentric drive shaft rotatably driven by the motor shaft about the central axis and having a drive member eccentrically offset from the central axis;

a sanding platen oriented adjacent to the housing second end and orbitally driven by the drive member, the platen having a planar surface perpendicular to the central axis adapted to receive sand paper; and a bearing interposed between the sanding platen and the eccentric drive shaft drive member freely rotatably connecting the sanding platen and drive member to cause the sanding platen to orbit as the motor rotates;

the eccentric drive further comprises a fan having a disc extending about and lying in a plane perpendicular to the motor axis and a plurality of generally uniformly shaped blades circumaxially spaced about the disc in a non-uniform manner in order to balance the eccentric drive and sanding platen sub-assembly about the motor axis; and the disc portion of the fan is generally uniform in thickness and each of the plurality of fan blades are generally uniform in thickness enabling the eccentric drive to be integrally formed as a metal die casting minimum porosity.

28. The orbital sander of claim 27 wherein the fan portion of the eccentric drive is not individually balanced post cast.

* * * * *